US008499990B2

(12) United States Patent
Smith

(10) Patent No.: US 8,499,990 B2
(45) Date of Patent: Aug. 6, 2013

(54) LANDING NET HOLSTER

(76) Inventor: Wayne Tracy Smith, North Shore (NZ)

( * ) Notice: Subject to any disclaimer, the term of this patent is extended or adjusted under 35 U.S.C. 154(b) by 380 days.

(21) Appl. No.: 12/895,839

(22) Filed: Sep. 30, 2010

(65) Prior Publication Data

US 2011/0240704 A1 Oct. 6, 2011

Related U.S. Application Data

(60) Provisional application No. 61/318,800, filed on Mar. 30, 2010.

(51) Int. Cl.
*A45F 3/14* (2006.01)
*A45F 5/00* (2006.01)
*A45F 3/00* (2006.01)

(52) U.S. Cl.
USPC ..... 224/676; 224/674; 224/251; 224/250

(58) Field of Classification Search
USPC ..... 224/676, 674, 251, 250
See application file for complete search history.

(56) References Cited

U.S. PATENT DOCUMENTS

| | | | | | |
|---|---|---|---|---|---|
| 969,524 | A | * | 9/1910 | Condon | 224/247 |
| 1,914,443 | A | | 6/1933 | Lemon | |
| 2,954,909 | A | * | 10/1960 | Miller et al. | 224/200 |
| 2,995,855 | A | * | 8/1961 | Bell | 43/21.2 |
| 3,874,573 | A | * | 4/1975 | Fruscella et al. | 224/242 |
| 4,006,851 | A | * | 2/1977 | Kippen | 224/197 |
| 4,420,104 | A | * | 12/1983 | DiIenno | 224/250 |
| 4,569,466 | A | * | 2/1986 | Webber | 224/673 |
| 4,621,753 | A | * | 11/1986 | Ridings | 224/673 |
| 4,662,552 | A | * | 5/1987 | Uyehara | 224/251 |
| 4,771,927 | A | * | 9/1988 | Ventura | 224/666 |
| 4,787,540 | A | * | 11/1988 | Barry | 224/192 |
| 4,807,788 | A | * | 2/1989 | Tolli | 224/197 |
| 4,830,247 | A | * | 5/1989 | Banks | 224/666 |
| 4,953,769 | A | * | 9/1990 | Parsons et al. | 224/247 |
| 4,955,518 | A | * | 9/1990 | Parsons et al. | 224/247 |
| 4,980,988 | A | | 1/1991 | Whitman | |
| 5,024,018 | A | * | 6/1991 | Ferrigno | 43/21.2 |
| 5,056,696 | A | * | 10/1991 | Lahr | 224/148.4 |
| 5,174,483 | A | * | 12/1992 | Moore et al. | 224/250 |
| 5,193,725 | A | * | 3/1993 | Radocy | 224/197 |
| D335,031 | S | * | 4/1993 | Resnik et al. | D3/221 |
| 5,263,619 | A | | 11/1993 | Shoemaker | |
| 5,325,991 | A | * | 7/1994 | Williams | 220/739 |
| 5,381,922 | A | * | 1/1995 | Gladman et al. | 220/481 |
| 5,511,336 | A | * | 4/1996 | Bishop | 43/21.2 |
| 5,535,928 | A | * | 7/1996 | Herring | 224/250 |
| 5,718,363 | A | * | 2/1998 | Graves | 224/250 |
| 5,797,212 | A | * | 8/1998 | Kistner et al. | 43/21.2 |
| 5,842,620 | A | * | 12/1998 | Koudakis | 224/673 |
| 5,967,345 | A | * | 10/1999 | Subotin | 211/119.007 |

(Continued)

FOREIGN PATENT DOCUMENTS

JP 10-248462 9/1998

*Primary Examiner* — Nathan J Newhouse
*Assistant Examiner* — Lester L Vanterpool

(57) ABSTRACT

The present invention provides a stabilized belt mounted fish landing net holster for anglers. The holster includes a belt-mounted base to which a cylindrical sleeve, which holds the handle of a landing net, is mounted in a vertical plane when the holster is worn on the belt of an angler or mounted to other gear such as back packs. The holster keeps the landing net secure, out of the way while fishing or walking and is easily withdrawn for use.

4 Claims, 3 Drawing Sheets

(56) References Cited

U.S. PATENT DOCUMENTS

| | | | | |
|---|---|---|---|---|
| 6,004,033 | A * | 12/1999 | Cirone | 383/24 |
| 6,032,841 | A * | 3/2000 | Johnson | 224/463 |
| 6,145,715 | A * | 11/2000 | Slonim | 224/148.3 |
| 6,176,403 | B1 * | 1/2001 | Svare et al. | 224/251 |
| 6,286,798 | B1 * | 9/2001 | Chun | 248/311.2 |
| 6,497,349 | B1 * | 12/2002 | Ramirez | 224/245 |
| 6,533,150 | B1 * | 3/2003 | Margo et al. | 224/250 |
| 7,066,361 | B1 | 6/2006 | Williams | |
| 7,210,604 | B2 * | 5/2007 | Kostal et al. | 224/200 |
| 7,584,710 | B2 | 9/2009 | Grundy | |
| 2005/0145663 | A1 | 7/2005 | Samuels | |
| 2006/0065689 | A1 | 3/2006 | Johnson | |
| 2008/0083803 | A1 * | 4/2008 | Brantner et al. | 224/666 |

* cited by examiner

LANDING NET HOLSTER

BACKGROUND OF THE INVENTION

1. Field of Invention

The present invention relates generally to a landing net holder for anglers, worn by a person while fishing, it secures a landing net to the angler.

Particularly to a stabilized belt mounted landing net holster, which is attached to an angler's belt in the area of their back. The holder keeps the net secure, restricts undesired movement of the net and keeps it out of the way when fishing. It holds the net in a position where it won't easily be caught in bushes or trees while walking and is easily withdrawn for use. The holster also allows the net to be carried without having to wear a fishing vest.

The holster may also be used as a general article carrier to hold items such as fishing rods, flashlights, wading staffs or tools.

A Landing net is a net used by an angler to help land a fish that has been hooked. It consists of a net or mesh basket held open by a hoop and a handle. The frames of modern nets are most often made of wood or aluminum while the net itself is most often constructed of woven nylon.

Landing nets are an awkward shape making them cumbersome to carry and fish with. The most common way of carrying one is by suspending it from a loop located at the back of the collar on a fishing vest using a mechanical or magnetic clip attached to the end of the net handle. Thus the landing net hangs handle-up and net-down in the center of a person back from the collar to waist. Though most anglers use this method there are many problems associated with carrying a landing net in this fashion:

- Where a mechanical clip is used it's difficult to reach behind your neck to unclip the hook that releases the net and even harder to reattach it.
- Using a magnetic clip makes it easier to detach the landing net, but it's difficult to reattach the mechanism when finished.
- The net has a tendency to swing from side to side while walking, irritating in its self; it also makes them prone to getting caught in brush and trees. It's such a problem that cables and even magnets are sold to stop this, but it just means more things to have attach and reattach every time it's used.
- They often fall over the shoulder and around to the front of an angler when bending down, getting in the way.
- The net must be worn with a fishing vest fitted with a loop at the color.

Alternatively, collapsible or folding nets are often carried in bags or pouches, not an alternative for non-collapsible nets. Another method is sticking the handle behind the anglers wading belt handle down in the center of the back. This is uncomfortable and overtime abrades breathable waders where the net contacts the waders causing them to leak.

The object of the present invention is to provide a landing net support, which overcomes the disadvantages referred to above.

2. Prior Art

There's little prior art that relates directly to belt mounted landing net holders and limited prior art on landing nets carriers in general. Prior art does exist on such items as belt-mounted carriers for guns, batons, flashlights and tools. Though the following art may have similar attributes to the present invention, it will be shown that all have distinct design, construction and material differences. Reference to relevant art follows:

(a) U.S. Pat. No. 1,914,443 represents a holder for a landing net, the general object of the invention being to provide a means for holding a landing net on the clothing or creel strap of a fisherman. In general this invention strives to solve the same problem as the present invention but differs in design and construction. The main difference being that it represents a mechanical clip to hold the net handle and not an adjustable sleeve.

(b) Japanese Pat. No. JP 02-084122 represents a belt-mounted carrier for a landing net. Again, this invention strives to solve the same problem as the present invention but differs in design and construction. The present invention includes a means of adjusting the circumference of the sleeve holding the net handle to receive and secure landing nets of different sizes and or shapes and, this invention does not.

(c) Japanese Pat. No. JP 10-248462 represents a belt-mounted carrier for an electronic fishing device. Again, even though there are some similarities to the cited art, the present invention includes a means of adjusting the circumference of the sleeve holding the net handle to receive and secure landing nets of different sizes and or shapes and, this invention does not.

(d) U.S. Pat. No. 4,662,552 represents "A baton holder for a side handle baton for law enforcement applications". This invention strives to solve a similar problem as the present invention but the inventions are significantly different. This invention incorporates a solid tube for holding a police baton where in the circumference of the holder is not adjustable to allow for it to hold different sizes of items, and uses straps forming belt loops to attach it's base to a belt. The present invention includes webbing coupled to it's base at one end and releasably attached to the base at it's other end where the webbing in rolled into the shape of an open ended tube creating the cradle that holds a landing net and where in the circumference is adjustable to hold different sizes and shapes of landing nets; this invention does not. The present inventions also incorporates cutouts in the base for a person's belt to be passed thru, again this invention does not.

(e) U.S. Pat. No. 4,980,988 represents a combination net holster and fishing creel. It's a bag held by the belt designed to carry a the net handle up with the net in the bag along with fish, not a sleeve holding the handle of the net, net side up.

(f) U.S. Pat. No. 5,263,619 represents a telescoping police baton holder, which comprises of some of the same components of the present invention, but the sleeve holding the baton incorporates a cover member to hold the baton in place, making the inventions significantly different. And again, the present patent invention includes a means of adjusting the circumference of the sleeve holding the net handle to receive and secure landing nets of different sizes and or shapes and, this invention does not.

(g) U.S. Pat. No. 5,797,212 represents a portable fishing gear holder comprises a single piece of plastic. This device can also hold a landing net, but significantly differs in design and construction. Again, the present invention includes a means of adjusting the circumference of the sleeve holding the net handle to receive and secure landing nets of different sizes and or shapes, and this invention does not.

(h) U.S. Pat. No. 7,066,361 represents another transport device for a landing net. It's another invention that's basically a bag worn like a backpack that the landing net fits into. Not a belt mounted device.

(i) U.S. Pat. No. 7,584,710 represents a method of manufacturing a synthetic holder for use on a duty belt. The present invention has a base member secured to a net cradle member;

this invention does not and again is significantly different in design from the present invention.

(j) U.S. Pat. No. 20050145663 represents a modular fishing belt. Again, the present invention includes a means of adjusting the circumference of the sleeve holding the net handle to receive and secure landing nets of different sizes and or shapes and, this invention does not.

(k) U.S. Pat. No. 20060065689 represents a flashlight holster. Even though this invention incorporates some of the same components of the present invention, again he present invention includes "a means of adjusting the circumference of the sleeve holding the net handle to receive and secure landing nets of different sizes and or shapes". This invention does not.

(l) U.S. Pat. No. 2,954,909 represents a fishing rod holder. This invention incorporates some of the same components of the present invention, but once again this invention incorporates a solid tube for holding a fishing rod where in the circumference of the holder isn't adjustable to allow for it to hold different sizes of items. The present invention includes webbing coupled to it's base at one end and releasably attached to the base at it's other end that forms an open ended tube creating the cradle that holds a landing net including "a means of adjusting the circumference of the sleeve holding the net handle to receive and secure landing nets of different sizes and or shapes", this invention does not. The present inventions also incorporates cutouts in its base for the webbing forming the sleeve to pass thru and outside cutouts to make it easier for a persons belt to be attached to a persons belt, again this invention does not.

(m) U.S. Pat. No. 6,176,403 represents a baseball bat, softball bat, and glove and ball holder. This invention holds a baseball bat "in a substantially horizontal position parallel to the waistline of the wear when the belt is worn by the wearer, and the bat holder having a first section, a second section, and a hinge between the first and second sections." The present invention includes "said landing net holster including a means that orientates the landing net in a substantially vertical position during operating conditions." This invention does not. Again the present invention includes a sleeve means that is coupled to it's base, and also incorporates: the said base means comprises a vertical cutout on both outer ends of the base plate where in a persons belt is treaded through the cutouts to secure the holster to the person", also including "where said base plate is further formed with two vertical cutouts positioned one each side of the lateral center line of the base plate and inward of the two vertical belt cutouts, which allows a sleeve member to be treaded through the cutouts supporting and stabilizing the sleeve member." This invention does not, and along with all the other differences making these two inventions substantially different.

(n) U.S. Pat. No. 5,325,991 represents a combined holder and support for a receptacle such as drink cups, cans, bottles, mugs . . . adapted to releasably hold the receptacle where the base is a thin and narrow elongated vertical support that releasable holds the support member, where the top of the support is folded upon itself forming a hook in order to hang the device from a persons belt or other object, and where the bottom section in formed in an "L" shape forming a lower stop portion. The present invention includes a sleeve means that is coupled to it's base, wherein the said base means comprises of a approximately rectangular or square piece of flat, rigid or semi rigid material(s) such a plastic or metal forming a base plate where said base plate comprises a vertical cutout on both outer ends of the base plate where in a persons belt is treaded through the cutouts to secure the holster to the person, also including "where said base plate is further formed with two vertical cutouts positioned one each side of the lateral center line of the base plate and inward of the two vertical belt cutouts, which allows a sleeve member to be treaded through the cutouts supporting and stabilizing the sleeve member." The present invention has a sleeve means that allows a landing net handle to pass thru it without the use of a bottom stop. This invention does not. Again the present invention also includes a sleeve means that is substantially coupled to its base, this invention does not.

(o) U.S. Pat. No. 4,953,769 represents a baton clip adapted for lateral withdrawal of a baton which comprises of some of the same components of the present invention, the sleeve in this case is described as a clip holding the baton which incorporates a means that allows the baton to be withdrawn laterally from it's clip. The present invention includes a means that doesn't allow the device to be removed from its sleeve laterally in an operational state. This invention does not. The present patent invention also includes a means of adjusting the circumference of the sleeve holding the net handle to receive and secure landing nets of different sizes and or shapes and this invention does not. The base of this invention is in the form of a narrow elongated vertical strap that is folder over and secured to itself forming a belt loop. The present invention includes a base means comprises of a approximately rectangular or square piece of flat, rigid or semi rigid material(s) such a plastic or metal forming a base plate where said base plate comprises a vertical cutout on both outer ends of the base plate where in a persons belt is treaded through the cutouts to secure the holster to the person, also including "where said base plate is further formed with two vertical cutouts positioned one each side of the lateral center line of the base plate and inward of the two vertical belt cutouts, which allows a sleeve member to be treaded through the cutouts supporting and stabilizing the sleeve member." This invention does not.

(p) U.S. Pat. No. 5,056,696 represents a beverage container holder comprising a single piece body including a lower container support and upper container retainer which is also comprised of a substantially flat lower support base which holds the container so it can't fail from the bottom base, it's basically an open sided tube with a top and bottom ring including a solid bottom. The present invention includes a landing net sleeve means where the sleeve means is an open-ended elongated tube portion comprised of a single length of an webbing member coupled to the base means at one end and releasably coupled to the base means at it's opposite end where the webbing member is formed into the open-ended elongated tube portion creating the sleeve means. The present invention also including "a means of adjusting the circumference of the sleeve holding the net handle to receive and secure landing nets of different sizes and or shapes", this invention does not. The present invention also has a means for allowing the net handle to pass thru the sleeve means in the form of an open bottom; this invention does not.

(q) U.S. Pat. No. 4,234,116 represents an adjustable carrier consisting of three main parts that holds and item by locking it in tightened condition. The carrier comprises a support means, and elongated strap means and a pair of vertically extending band-engaging members in the form of a ridged loop. The strap means is threaded thru the base means at both ends of the base means and around the ridged loop which is held behind the base forming an intermediate span and two free ends from the strap means used to secure both the strap means and article the invention secures. This invention holds and item by locking it in place with the use of pressure between the intermediate span and the support base. Furthermore "the means for mounting the support to the belt is a horizontal slot through the support to permit the support to be engaged with a carried by a belt and in which the band-engaging members are accommodate within the horizontal slot between the belt and exterior portion of the support." The present invention includes a means where the strap means is connected directly to it's base means, not around a further third "band-engaging members": The present invention "said landing net sleeve means is an open-ended elongated tube portion comprised of a single length of an webbing member coupled to the base means at one end and releasably coupled to the base means at it's opposite end where the webbing member is formed into the open-ended elongated tube portion creating the sleeve means. This invention does not. The present invention sleeve means is in the form of a single sided tube; this invention does not as it has and intermediate loop depending on an additional two free ends to secure it. Furthermore, the present invention includes a base means comprises of a approximately rectangular or square piece of flat, rigid or semi rigid material(s) such a plastic or metal forming a base plate where said base plate comprises a vertical cutout on both outer ends of the base plate where in a persons belt is treaded through the cutouts to secure the holster to the person, also including "where said base plate is further formed with two vertical cutouts positioned one each side of the lateral center line of the base plate and inward of the two vertical belt cutouts, which allows a sleeve member to be treaded through the cutouts supporting and stabilizing the sleeve member." This invention does not.

(r) U.S. Pat. No. 4,771,927 represent a carrier device for a phone. Though the inventions share some similarities of design, both inventions are also uniquely different. This invention also holds and item by locking it in tightened condition, which comprises a support means in the form of a see thru woven strap. This invention holds and item by locking it in place with the use of pressure between the strap and the support base. The present invention also comprises a support means in the form of a strap; but it further includes a strap support means in the base "where said base plate is further formed with two vertical cutouts positioned one each side of the lateral center line of the base plate and inward of the two vertical belt cutouts, which allows a sleeve member to be treaded through the cutouts supporting and stabilizing the sleeve member." This invention does not. This has two main advantages over the phone holder. One, the vertical base slots hold the strap in it's desired shape which allows the landing net handle to be supported loosely in the strap allowing for easy insertion and removal when in use and is not reliant on strap tension to hold an object. Two: the vertical base slots help to secure the releasable end of the strap while allowing the strap to be easily adjustable.

Furthermore, the base of this invention is in the form of a narrow elongated vertical strip that is folder over itself forming a belt loop. The present invention includes a base means comprises of a approximately rectangular or square piece of flat, rigid or semi rigid material(s) such a plastic or metal forming a base plate where said base plate comprises a vertical cutout on both outer ends of the base plate where in a persons belt is treaded through the cutouts to secure the holster to the person. This invention does not.

3. Objects and Advantages

In keeping with the principle of the present invention the landing net holster is unique and technically different from other forms of holsters.

The landing net holster is uncomplicated in design, ergonomic and comfortable to wear. It's versatile; it can be attached and worn with a common waist belt over trousers or on a wading belt over waders and it doesn't have to be worn with a fishing vest. The net is held securely and in a fashion to be out of the way of the angler while fishing and walking while allowing easy access to the net.

The positioning of the net also means the netting has little chance of being caught in brush and trees while walking. It's construct of materials that can stand up to the rigors of fishing and is easily maintained.

Therefore the primary objective of the present invention is to provide a stabilized belt mounted landing net holster for use by anglers while fishing in streams, lakes, flats fishing in salt water and the like. The holster may also be used as a general article carrier to hold items such as fishing rods, wading staffs, flashlights, or tools.

The sleeve holding the net handle is adjustable to accommodate different types and sizes of nets. The sleeve is constructed of pliable materials such as leather or nylon webbing in the form of a strap. The strap is permanently attached at one end to the flat side of the support member and rolled upon itself forming a sleeve in the form of a tube having two open ends creating a cradle to hold the net handle. The loose end of the strap is held release ably to the base by fasteners such as hook and loop materials, making the strap adjustable. How tightly the strap is rolled into a tube shape dictates the circumference of the sleeve.

Accordingly, there is a need to provide an improved landing net holster for anglers.

SUMMARY

It is therefore an object of the invention to provide a landing net holster to enable an angler to comfortably and securely carry a landing net while allowing easy access to the net.

It is also an object of the invention to provide a landing net holster that stabilizes the net while walking so that the net doesn't swing from side to side; in a position which gives the netting little chance of catching in brush and trees; or fall across an anglers shoulders while bending over.

It is another object of the invention to provide a landing net holster, which is capable of holding different types and sizes of landing nets and general articles.

It is still another object of the invention to provide a landing net holster that can be securely fastened to different types and sizes of belts.

It is a further object of the invention to provide a means of carrying a landing net without having to wear a fishing vest.

It is also an object of the invention to provide a landing net holster which can stand up to the rigors or fishing while being easy to clean and maintain.

In accordance with the above and the other objects of the present invention, which will be discussed in detail below, a belt-mounted landing net holster is provided. The one-piece holster is made primary of two members coupled together, a support member that includes belt loop cutouts for attaching the holster to a belt and a net cradle member in the form of a sleeve for securing the handle of a landing net or carrying other items.

Preferred embodiments of the invention are disclosed in the following descriptions.

According to a first embodiment of the invention, the landing net holster in its simplest form includes a support member and a cradle member. The support member comprises a base plate constructed of a approximately rectangular or square piece of rigid or semi-rigid materials like plastic or metal and having vertical cutouts on the outer ends of the base plate in which an anglers (wading) belt is treaded thru to secure the holster to the angler. The outer ends of the plate comprising the vertical belt cutouts maybe be off-stetted towards the back side of the holster making it easier to thread a belt thru the base. Another feature of the base plate in this embodiment is the addition of two vertical cutouts in the base member used to secure the sleeve member to the base member, they are placed either side of the lateral centerline of the base plate and inward of the two belt cutouts in which a sleeve member such as pliable or semi-pliable nylon webbing is treaded thru and supported. This configuration allows for the sleeve member to be secured to the base member in the shape of a tube while allowing the sleeve member to be adjustable to accommodate different types and sizes of nets. The sleeve is constructed of pliable materials such as nylon webbing in the form of a strap. The strap is permanently attached at one end to the flat side of the support member and rolled upon itself forming a sleeve in the form of a tube having two open ends creating a cradle to hold the net handle. The free end of the strap is held releasably to the base and secured end of the strap by fasteners such as hook and loop materials allowing the strap to be adjustable. How tightly the strap is rolled into a tube shape dictates the circumference of the sleeve.

According to a second embodiment of the invention, the sleeve means comprises a means of pivoting the sleeve means in relation to the base means.

Other objects and advantages of the present invention will become apparent to those skilled in the art upon reference to the following detailed description and appended claims, and upon reference to the accompanying drawings.

DRAWINGS

Figures

In the drawings, closely related figures have the same number but different alphabetic suffixes.

FIG. 1 is an elevational view, partly broken away, illustrating the landing net FIG. 2A is a perspective view of the preferred embodiment where the base is comprised of a rigid or semi-rigid base plate made of metal or plastic where the anglers belt is threaded thru two cutouts in the base to secure the holster to the angler and also illustrating how the sleeve member passes thru two other cut outs in the base, and a showing a rivet securing one end of the sleeve to the base.

DRAWINGS

Reference Numerals

Figure 1:
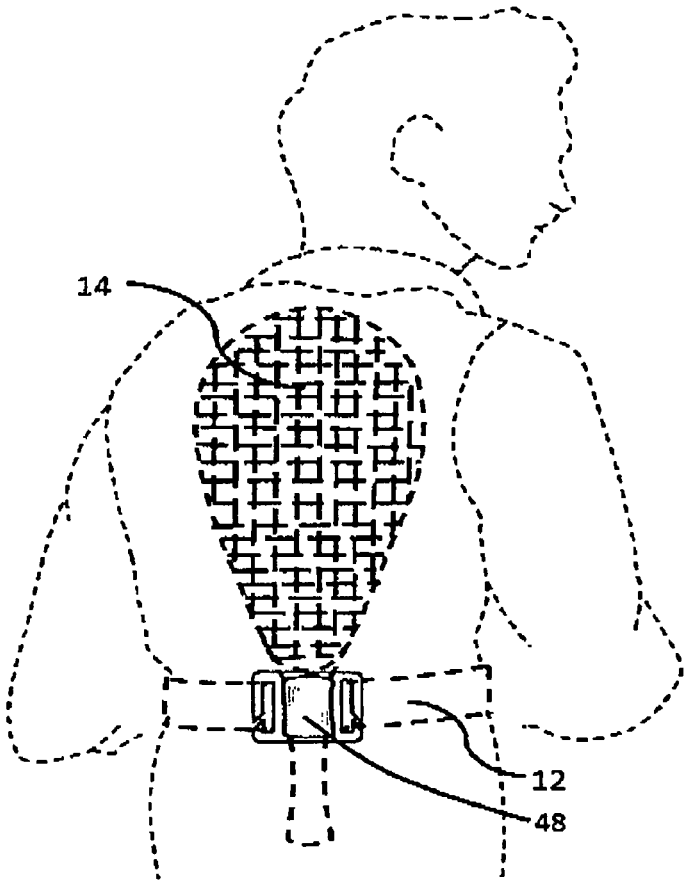

| | | | |
|---|---|---|---|
| 6 | base | 10 | sleeve |
| 12 | belt | 14 | landing net |
| 28 | hook and loop materials | 34 | belt insertion cutout |
| 38 | hole for fastener | 42 | rivet |
| 46 | belt loop cutout | 48 | landing net holster |
| 50 | belt slot cutout | 52 | sleeve slot cutout |

DETAILED DESCRIPTION OF THE PREFERRED EMBODIMENT (S)

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

With reference to the drawings, in general, and to FIG. 1 in particular, multi-featured landing net holster #48 embodying the principles of the present invention is generally depicted. The net #14 and wading belt #12 are shown on an anglers back.

Figure 2A:
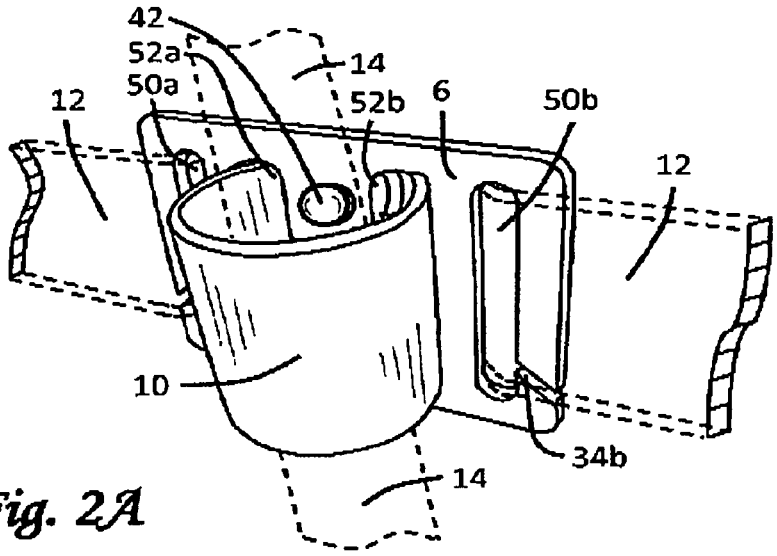
FIG. 2B is a top view further illustrating how the angler's belt and the webbing forming the adjustable sleeve member is threaded thru the base plate, also illustrating a rivet securing one end of the sleeve to the base and hook and loop materials also securing the sleeve.
FIG. 2C is a side view of the holster illustrating the sleeve member position.
FIG. 2D is a front view of the holster better illustrating the general layout of the base plate.
FIG. 2E is a rear view of the holster illustrating the base plate and the sleeve.

The landing net holster in one preferred embodiment FIG. 2A a perspective front view of the landing net holster, the support means is comprised of a base plate #6, formed of a piece of rigid or semi-rigid material like plastic or metal. A wading belt #12 is threaded thru two belt slot cutouts #50*a* and #50*b*, in the base plate #6. The net cradle means #10 is formed of semi-rigid pliable nylon webbing which is threaded thru two vertical sleeve slot cutouts #52*a* and #52*b* forming a elongated tube shape, a landing net handle #14 inside the net cradle formed by the sleeve #10, a rivet #42 is securing one end of the sleeve #10 to the base plate #6.

Figure 2B:
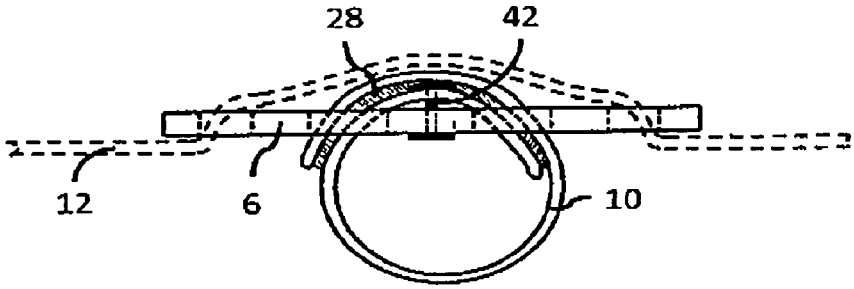

FIG. 2B is a top plan view of the preferred embodiment of FIG. 2A showing how the wading belt #12 and the cradle member strap #10 are threaded thru the base member #6. It also details how the adjustable cradle member strap #10 is formed into an elongated tube and the rivet #42 attaching one end of the strap #10 to the base #6, and the hook and loop materials #28 that holds the releasably secured end of the strap #10.

Figure 2C:
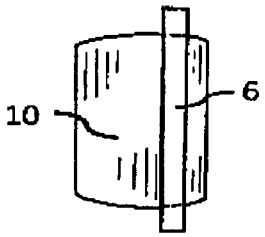

FIG. 2C is a side elevation of the preferred embodiment of FIG. 2A which shows in more detail how the cradle member strap #10 is threaded thru the base plate #6.

Figure 2D:
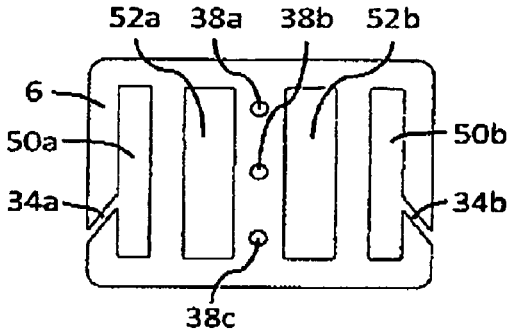

FIG. 2D is a front elevation view of the preferred embodiment of FIG. 2A showing the base member #6, without the sleeve member in order to show in more detail the general layout of the belt slot cutouts #50*a* and #50*b*, the sleeve slot cutouts #52*a* and 52*b*, the belt insertion cutouts #34*a* and 34*b*, and the strap fastener holes #38*a*, #38*b* and #38*c*.

Figure 2E:
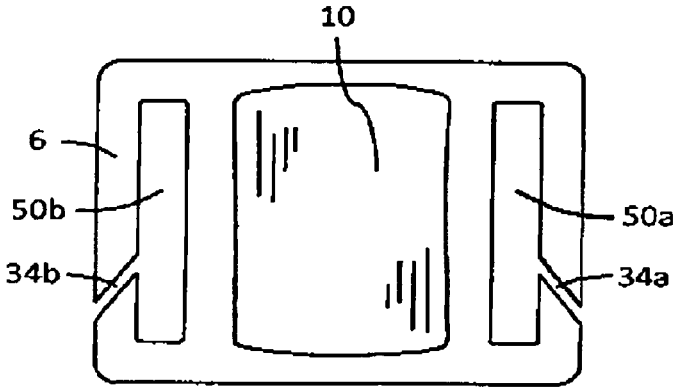

FIG. 2E is a rear elevation view of FIG. 2A detailing the back of the holster with the sleeve member #10, the belt slot cutouts #50*a* and #50*b*, and the two belt insertion cutouts #34*a* and #34*b*, in the base #6.

One or more of the various advantageous features of the present invention may be incorporated into the landing net holster for beneficial results. These features provide benefit individually as well as collectively to produce a landing net holster.

The foregoing description should be considered as illustrative only of the principles of the invention. Since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim is:

1. A landing net holster for anglers comprising:

(a) base means;

(b) landing net retention means coupled to the base means;

(c) said landing net retention means including sleeve means for receiving and holding the handle of the landing net;

(d) said landing net sleeve means is an open-ended elongated tube portion comprised of an webbing member coupled to the base means at one end and releasably coupled to the base means at it's opposite end where the webbing member is formed into the open-ended elongated tube portion creating the sleeve means;

(e) said landing net sleeve means including a means of adjusting the circumference of the sleeve means allowing the sleeve means to receive and secure landing nets of different sizes and or shapes;

(f) said landing net holster including a means that orientates the landing net in a substantially vertical position during operating conditions comprising the base means coupled to said sleeve means where said sleeve means is orientated perpendicular to a person belt, holding a landing net vertically when in use;

(g) said base means comprises of an approximately rectangular or square piece of flat, rigid or semi rigid material(s) forming a base plate where said base plate comprises vertical belt cutouts on both outer ends of the base plate where in a persons belt or a strap is threaded through the two vertical cutouts to secure the holster to the person or their gear;

(h) said base plate is further formed with two vertical cutouts positioned one each side of the lateral center line of the base plate and inward of the two vertical belt cutouts, which allows said sleeve means to be threaded through the two vertical cutouts supporting and stabilizing the sleeve means.

2. Landing net holster as claimed in claim 1 wherein the base plate and webbing member is further comprised of mechanical fasteners such as rivets, nuts and bolts or screws that couples one end of the webbing to the base plate.

3. Landing net holster as claimed in claim 1 wherein the base plate and webbing member further comprises mechanical fasteners such as patches of hook and loop materials or snaps that releasable couple the releasable end of the webbing member to the base plate.

4. Landing net holster as claimed in claim 1 where the outer ends of the said base plate comprising the two vertical belt cutouts is formed with a further two cutouts which are positioned one on each end of the base plate between the vertical belt cutouts and the outside edge of the base plate allowing alternative access for a belt or strap into the two vertical belt cutout.

* * * * *